US008864352B2

(12) United States Patent
Kloos

(10) Patent No.: US 8,864,352 B2
(45) Date of Patent: Oct. 21, 2014

(54) LIGHTING DEVICE FOR VEHICLES

(71) Applicant: HELLA KGaA, Lippstadt (DE)

(72) Inventor: Gerhard Kloos, Erwittle (DE)

(73) Assignee: HELLA KGaA, Lipstadt (DE)

( * ) Notice: Subject to any disclaimer, the term of this patent is extended or adjusted under 35 U.S.C. 154(b) by 201 days.

(21) Appl. No.: 13/646,090

(22) Filed: Oct. 5, 2012

(65) Prior Publication Data

US 2013/0094236 A1 Apr. 18, 2013

(30) Foreign Application Priority Data

Oct. 6, 2011 (DE) ..... 10 2011 054 230

(51) Int. Cl.
*F21V 7/00* (2006.01)
*F21S 8/10* (2006.01)

(52) U.S. Cl.
CPC ..... *F21V 7/00* (2013.01); *F21S 48/1329* (2013.01); *F21S 48/1154* (2013.01)
USPC ..... 362/516; 362/543

(58) Field of Classification Search
USPC ..... 362/516, 543
See application file for complete search history.

(56) References Cited

U.S. PATENT DOCUMENTS 5,700,078 A * 12/1997 Fohl et al. ..... 362/553

* cited by examiner

*Primary Examiner* — Vip Patel
(74) *Attorney, Agent, or Firm* — Husch Blackwell LLP

(57) ABSTRACT

A lighting device for vehicles with a plurality of light sources arranged like a matrix in a light generation level, with one light forming optic unit being arranged in the primary direction of emission in front of the light source, and with a pre-optic unit arranged between the light forming optic unit and the light sources, comprising a plurality of pre-optic elements, characterized in that the pre-optic elements are embodied as planar band elements provided with reflective flat sides and that the plurality of pre-optic elements form a band grid with a plurality of recesses, each allocated to the light sources.

11 Claims, 2 Drawing Sheets

LIGHTING DEVICE FOR VEHICLES

CROSS REFERENCE

This application claims priority to German Patent Application No. 10 2011 054230.2, filed Oct. 6, 2011.

TECHNICAL FIELD OF THE INVENTION

The invention relates to a lighting device for vehicles with a plurality of light sources arranged in the form of a matrix in a light generation level, comprising a light forming optic unit arranged in front of the light sources in the primary direction of emission and with a pre-optic unit arranged between the light forming optic unit and the light sources showing a plurality of pre-optic elements.

BACKGROUND OF THE INVENTION

A lighting device for vehicles is known from DE 10 2008 005 488 A1, which shows a plurality of LED light sources arranged like a matrix. A pre-optic unit and a light forming optic unit are located in front of the LED light sources in the primary direction of emission. The pre-optic unit comprises a plate equipped with fine-structured elements. The fine-structured elements allow a spreading of the LED light sources displayed as light spots in the distribution of light so that a homogenization of the distribution of the light intensity occurs below the light-dark limit of the light distribution.

A lighting device for vehicles is known from DE 10 2008 013 603 A1 comprising a plurality of LED light sources arranged like a matrix. A light forming optic unit is arranged in front of the LED light sources. A pre-optic unit is arranged between the light forming optic unit and the LED light sources comprising a plurality of pre-optic elements, respectively allocated to the LED light sources. The pre-optic elements expand conically in the primary direction of emission and shall lead to a homogenization of the distribution of the light intensity.

The distances of the LED light sources may vary in their level of light generation depending on their production. Accordingly there is a desire to compensate the distances of the optic means such that the requested light distribution can be generated.

SUMMARY OF THE INVENTION

The objective of the present invention is therefore to further develop a lighting device for vehicles with a plurality of light sources arranged in a light generation level like a matrix such that an adjustment of the light sources arranged at a predetermined distance from each other to a light forming optic unit to generate light distribution can be ensured in a simple fashion.

In order to attain this objective the invention, in connection with the preamble of claim 1, is characterized in that the pre-optic elements are provided with planar band elements comprising reflective flat sides and the plurality of pre-optic elements form a band grid with a plurality of recesses, respectively allocated to the light sources.

According to the invention a pre-optic unit comprises a band grid composed from band elements provided with planar and reflective flat sides. Here, recesses form, respectively allocated to the light sources, limited by reflective, preferably rectangular surfaces. The surfaces limiting the recesses are parallel in reference to the primary direction of emission. The band grid according to the invention allows an adjustment of the light sources arranged in the level of the light generation to a light forming optic unit, wherein here particularly undesired gaps of adjacent light source images are avoided in the light distribution. This allows the pre-optic unit according to the invention to homogenize the light distribution.

According to a preferred embodiment of the invention the pre-optic unit is arranged directly in front of the light generation level. The pre-optic unit allows the generation of a virtual light source arrangement, which allows different distances of the light sources in the light generation level adjusted to the light forming optic unit.

According to a further embodiment of the invention adjacently arranged planar band elements of the band grid are arranged perpendicular in reference to each other. Recesses form with a rectangular and/or square frame for the light sources. At the areas adjacent to the recesses a repeated reflection occurs of the light emitted by the respective light sources.

According to a further development of the invention the planar band elements are embodied like a comb with lateral slots, with band elements arranged perpendicular in reference to each other engaging via the lateral slot. The band grid is advantageously composed by band elements showing a simple geometry, which allow additionally a simple assembly due to the comb-like design.

According to a further development of the invention the reflective flat sides of the band elements are coated high-gloss so that a high degree of reflection is given.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
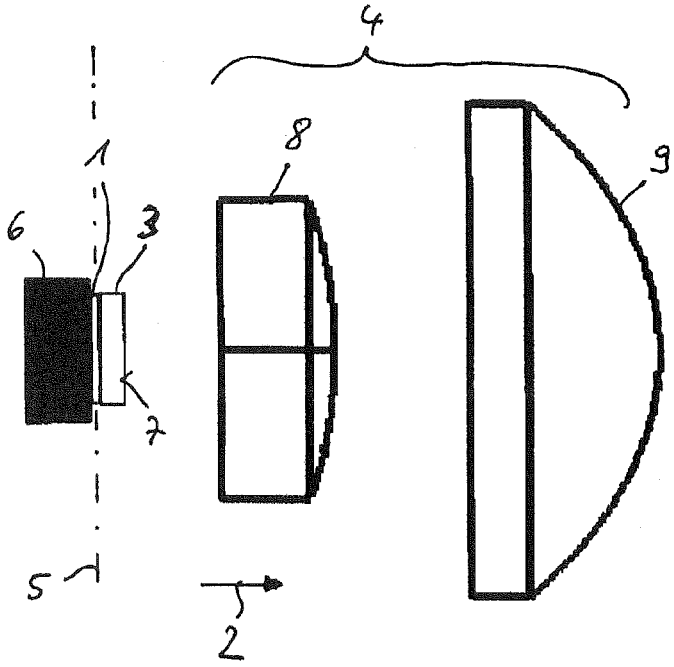
FIG. 1 A schematic side view of a lighting device.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

A lighting device according to the invention for vehicles is preferably used in head-lights to generate a distribution of high beams that can be controlled, in which in order to avoid any undesired blinding of vehicular objects ahead of the headlights, preferably by switching off respective sections of the light distribution, the respective vehicular objects can be shaded.

The lighting device essentially comprises a matrix 1 of light sources, a pre-optic device 3 arranged directly in front of the light source matrix 1 in the primary direction of emission 2, and a light forming optic unit 4 arranged in front of the pre-optic unit 3 in the primary direction of emission 2. The light sources are formed from LED light sources and/or LED chips arranged on a common carrier in a light generation level 5. The carrier of the light sources and/or the light source matrix 1 is preferably fastened on a cooling body 6, which extends on a side of the matrix 1 facing away from the pre-optic unit 3.

The pre-optic unit 3 comprises a front edge 7, arranged in a focal level of a light forming optic unit 4 comprising a first lens 8 and a second lens 9.

Figure 2:
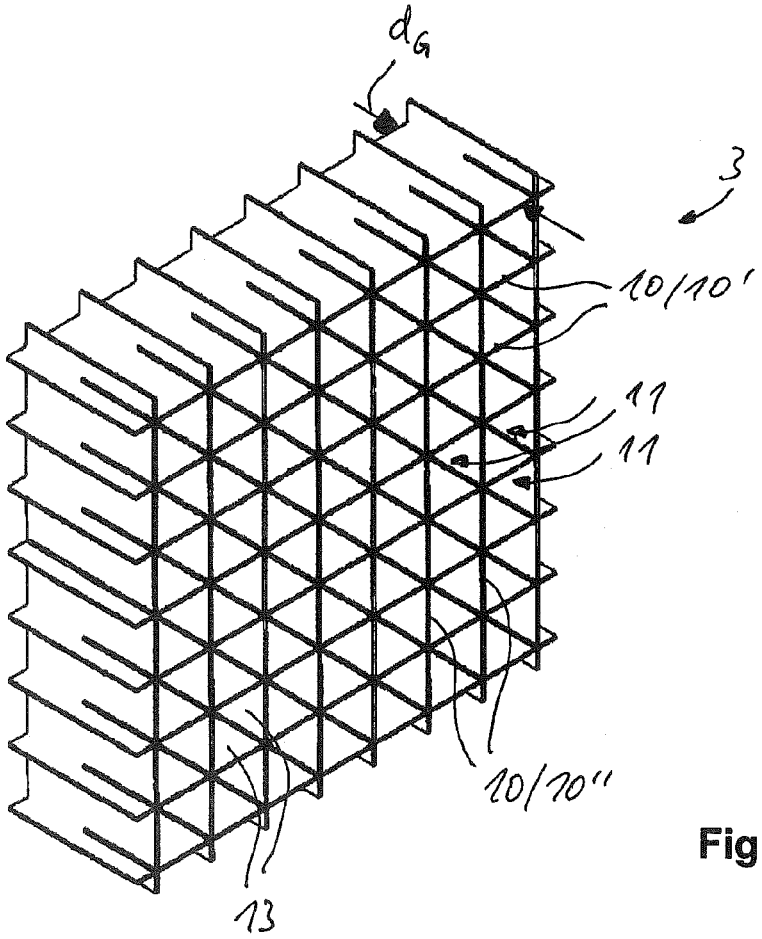
FIG. 2 a perspective front view of a pre-optic unit embodied as a band grid, and FIG. 3 an exemplary illustration of two band elements before they are connected to each other via lateral slots.

In order to adjust the light source matrix 1 to the light forming optic unit 4 the pre-optic unit 3 shows a band grid, which is formed from a plurality of planar pre-optic elements and/or planar band elements 10 arranged at a right angle in reference to each other. As discernible from FIG. 2, the band grid 3 comprises a plurality of linearly arranged band elements 10' and a plurality of column-like arranged linear elements 10", with rectangular and/or square recesses 11 being formed, each allocated to a light source of the light source matrix 1.

Figure 3:
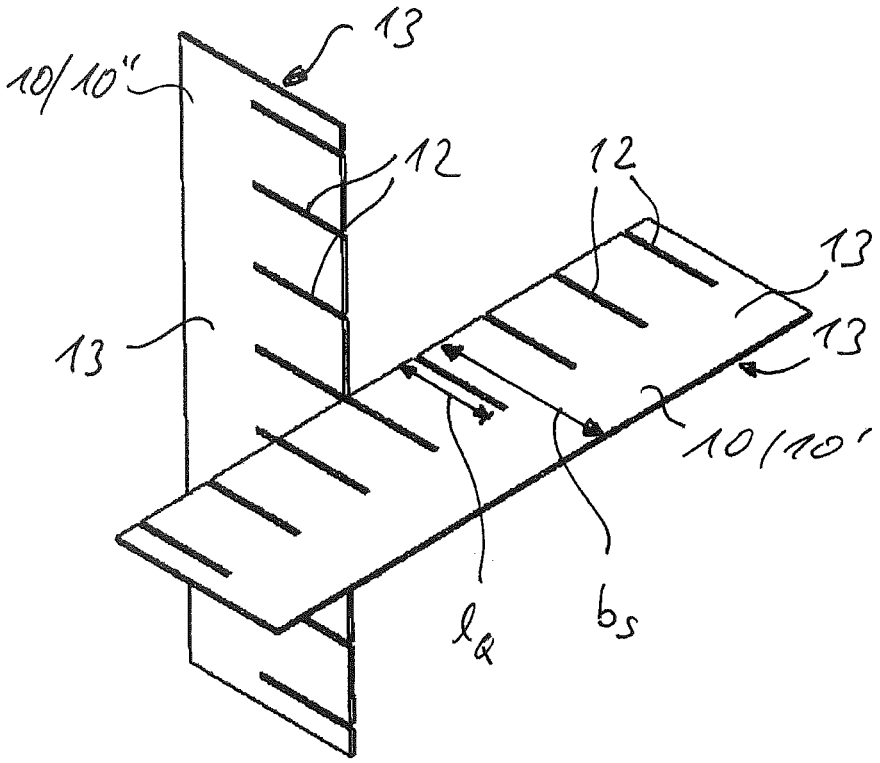

In FIG. 3 it is discernible that the band elements 10 are embodied like combs and show a number of lateral slots 12, by which the band element 10' arranged in a line can be connected to the band element 10" arranged in a column.

The band elements 10 are embodied identical, with the lateral slots 12 showing a length $l_Q$ greater than half the width $b_s$ of the band element 10. This way it is ensured that a thickness $d_G$ of the band grid 3 coincides with the width $b_S$ of the band elements 10.

The lines 10' of the band elements 10 and the columns 10" of band elements 10 are arranged perpendicular in reference to each other. The band elements 10 each show opposite reflective flat sides 13, which are generated by coating the band elements 10 with a high-gloss and/or highly reflective material. The thickness $d_G$ of the band grid 3 and/or the width $b_s$ of the band elements 10 is selected such that at the flat sides 13 limiting the recess 11 a repeated reflection occurs of the light emitted by the light sources. The width $b_S$ of the band elements 10 ranges from 2 mm to 5 mm, preferably showing a width $b_S$ of 3 mm.

The band elements 10 are preferably embodied stiffly and show a thickness $d_S$ in the range from 0.06 mm to 0.5 mm.

According to an alternative embodiment of the invention, not shown, the recesses may also be embodied trapezoidal or rhombus-shaped instead of showing a rectangular and/or square cross section.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

LIST OF REFERENCE CHARACTERS

1 Matrix
2 Primary direction of emission
3 Band grid
4 Light deformation optic unit
5 Light generation level
7 Front edge
8 First lens
9 Second lens
10 Pre-optic unit
11 Recess
12 Lateral slot
13 Reflective flat side

The invention claimed is:

1. A lighting device for vehicles with a plurality of light sources arranged like a matrix in a light generation level, comprising a light forming optic unit arranged in front of the light sources in the primary direction of emission and a pre-optic unit between the light forming optic unit and the light sources further comprising a plurality of pre-optic elements, wherein the pre-optic elements are embodied as planar band elements provided with reflective planar sides and the plurality of pre-optic elements form a band grid with a plurality of recesses, respectively allocated to light sources.

2. The lighting device according to claim 1, wherein the band grid directly follows the light generation level in the primary direction of emission.

3. The lighting device according to claim 1, wherein the band grid shows such a thickness that the light entering the recesses thereof is reflected several times at the reflective planar sides of the band elements.

4. The lighting device according to claim 1, wherein the planar band elements of the band grid, arranged adjacent in reference to each other, are arranged perpendicular and at the same distance from each other.

5. The lighting device according to claim 1, wherein the planar band elements are each embodied oblong and comb-like with a number of lateral slots, wherein band elements arranged perpendicular in reference to each other can be connected via the lateral slot.

6. The lighting device according to claim 1, wherein the reflective planar sides of the band elements are coated high-gloss.

7. The lighting device according to claim 1, wherein the planar band elements are embodied stiffly and/or wherein the planar band elements show a thickness ranging from about 0.06 mm to about 0.5 mm.

8. The lighting device according to claim 1, wherein the planar band elements show a width ranging from about 2 mm to about 5 mm, preferably a width of 3 mm.

9. The lighting device according to claim 1, wherein the light forming optic unit comprises at least one lens and wherein a frontal edge of the band grid in the primary direction of emission is arranged in a focal level of the light forming optic unit.

10. The lighting device according to claim 1, wherein the light sources are embodied as LED light sources and/or LED chips, held on a common carrier and/or a cooling body.

11. The lighting device according to claim 8, wherein the planar band elements show a width of about 3 mm.

* * * * *